US008840435B2

(12) United States Patent
Plazio et al.

(10) Patent No.: US 8,840,435 B2
(45) Date of Patent: Sep. 23, 2014

(54) ELECTRICAL CONNECTOR WITH AN OUTER HOUSING, AN INNER HOUSING AND AN INDICATOR SLEEVE

(75) Inventors: Adriano Plazio, Turin (IT); Fulvio Amerio, Turin (IT); Markus Eckel, Burstadt (DE)

(73) Assignees: Tyco Electronics AMP Italia SRL, Turin (IT); Tyco Electronics AMB GmbH, Bensheim (DE)

( * ) Notice: Subject to any disclaimer, the term of this patent is extended or adjusted under 35 U.S.C. 154(b) by 48 days.

(21) Appl. No.: 13/813,140

(22) PCT Filed: Jul. 15, 2011

(86) PCT No.: PCT/EP2011/062120

§ 371 (c)(1),
(2), (4) Date: Jan. 29, 2013

(87) PCT Pub. No.: WO2012/013518

PCT Pub. Date: Feb. 2, 2012

(65) Prior Publication Data

US 2013/0130535 A1 May 23, 2013

(30) Foreign Application Priority Data

Jul. 30, 2010 (EP) ..... 10007966

(51) Int. Cl.

| | |
|---|---|
| ***H01R 13/502*** | (2006.01) |
| ***H01R 13/506*** | (2006.01) |
| *H01R 13/6582* | (2011.01) |
| *H01R 13/52* | (2006.01) |
| *H01R 13/516* | (2006.01) |

(52) U.S. Cl.

CPC ..... *H01R 13/502* (2013.01); *H01R 13/6582* (2013.01); *H01R 13/506* (2013.01); *H01R 13/5221* (2013.01); *H01R 13/516* (2013.01)

USPC ..... 439/701; 439/607.41

(58) Field of Classification Search

USPC ..... 439/701, 607.41

See application file for complete search history.

(56) References Cited

U.S. PATENT DOCUMENTS

| | | | | |
|---|---|---|---|---|
| 6,514,098 | B2 * | 2/2003 | Marpoe et al. | 439/352 |
| 6,705,882 | B2 * | 3/2004 | Casses | 439/157 |

(Continued)

FOREIGN PATENT DOCUMENTS

| | | | |
|---|---|---|---|
| EP | 0903814 | A1 | 3/1999 |
| WO | WO 2008/109109 | A1 | 9/2008 |

OTHER PUBLICATIONS

International Search Report and Written Opinion issued by the European Patent Office, dated Nov. 21, 2011, for related International Application No. PCT/EP2011/062120; 12 pages.

(Continued)

*Primary Examiner* — Ross Gushi

(74) *Attorney, Agent, or Firm* — Faegre Baker Daniels LLP

(57) ABSTRACT

The invention relates to an electrical connector (1) with an inner housing (2), an outer housing (3) and a locking arrangement (L). In order to provide a control mechanism for a correct insertion of the inner housing (2) into the outer housing C(3), the invention provides that the electrical connector (1) has an indicator sleeve (18), whose insertion into the outer housing (3) is blocked by the locking arrangement (L), if the inner housing (2) is incompletely inserted into the outer housing (3).

13 Claims, 11 Drawing Sheets

(56) References Cited

U.S. PATENT DOCUMENTS

| | | | | |
|---|---|---|---|---|
| 7,066,773 | B1 * | 6/2006 | Martin | 439/752 |
| 7,083,471 | B2 * | 8/2006 | Hayashi | 439/607.53 |
| 7,399,195 | B2 * | 7/2008 | Kim et al. | 439/352 |
| 7,470,138 | B1 * | 12/2008 | Chen et al. | 439/352 |
| 7,540,772 | B2 * | 6/2009 | Sardi et al. | 439/581 |
| 7,744,390 | B2 * | 6/2010 | Tyler et al. | 439/157 |
| 8,419,485 | B2 * | 4/2013 | Stausser et al. | 439/752 |
| 2002/0086575 | A1 * | 7/2002 | Marpoe et al. | 439/352 |
| 2002/0090849 | A1 * | 7/2002 | Shuey et al. | 439/157 |
| 2003/0060084 | A1 * | 3/2003 | Aoki | 439/610 |
| 2004/0248453 | A1 * | 12/2004 | McLauchlan et al. | 439/352 |
| 2005/0176298 | A1 * | 8/2005 | Flowers et al. | 439/595 |
| 2007/0026705 | A1 * | 2/2007 | Tyler | 439/157 |
| 2007/0224862 | A1 * | 9/2007 | Tyler | 439/157 |
| 2009/0023325 | A1 * | 1/2009 | Chen et al. | 439/352 |
| 2009/0035993 | A1 * | 2/2009 | Okayasu | 439/610 |
| 2009/0291583 | A1 * | 11/2009 | Martin et al. | 439/342 |
| 2009/0311896 | A1 * | 12/2009 | Myer et al. | 439/248 |
| 2010/0227494 | A1 * | 9/2010 | Tyler et al. | 439/372 |
| 2012/0196465 | A1 * | 8/2012 | Stausser et al. | 439/282 |
| 2012/0196467 | A1 * | 8/2012 | Liptak et al. | 439/345 |
| 2013/0052866 | A1 * | 2/2013 | Ii | 439/607.41 |
| 2013/0130535 | A1 * | 5/2013 | Plazio et al. | 439/350 |
| 2013/0143448 | A1 * | 6/2013 | Eckel et al. | 439/686 |
| 2013/0230996 | A1 * | 9/2013 | Klein et al. | 439/271 |
| 2014/0106597 | A1 * | 4/2014 | Gimbel et al. | 439/345 |

OTHER PUBLICATIONS

European Search Report issued by the Munich Patent Office, dated Dec. 1, 2010, for related Application No. EP 10007966.4; 4 pages.

International Preliminary Report on Patentability issued by the International Bureau of WIPO, Geneva, Switzerland, dated Feb. 5, 2013, for related International Application No. PCT/EP2011/062120; 7 pages.

* cited by examiner

ELECTRICAL CONNECTOR WITH AN OUTER HOUSING, AN INNER HOUSING AND AN INDICATOR SLEEVE

The invention relates to an electrical connector with an inner housing that is adapted to receive at least one contact assembly, an outer housing and a locking arrangement, wherein the inner housing is adapted to be inserted into the outer housing in a contact direct during an assemblage of the connector and wherein the relative position of the inner to the outer housing is secured by the locking arrangement in a final assembly state of the connector.

Electrical connectors of the above mentioned type are known from the prior art. Yet, during the assembly of the known electrical connectors, the inner housing may insufficiently be inserted into the outer housing. An incompletely assembled connector may not work properly. Thus, an object of the invention is to provide an electrical connector, whose correct assembly can be controlled.

The object is achieved in that the connector has an indicator sleeve that is adapted to be inserted into the outer housing against the contact direction during the assemblage of the connector and in that, in an incomplete assembly state, in which the inner housing is arranged at a distance from its final assembly position in the outer housing, the locking arrangement forms a stop face for the indicator sleeve, blocking a transfer of the indicator sleeve into its final assembly position.

An operator or a machine, who or which inserts the indicator sleeve into the outer housing, can detect that the indicator sleeve cannot be transferred into its final assembly position. This indicates that the previous assembly steps may have been performed erroneously.

The solutions according to the invention can be combined as desired and further improved by the further following embodiments that are in each case advantageous on their own.

The indicator sleeve may basically comprise a hollow cylindrical shape and extend along the contact direction when mounted to the outer housing. A counter connector, which may be mated with the electrical connector, may at least section-wise extend through the indicator sleeve in the mated state.

According to a first possible embodiment, the connector may have a front seal that is adapted to seal the outer housing and a housing of the mated counter connector. The front seal can be retained in a sealing position in the outer housing by the indicator sleeve at least in the final assembly state. Retaining the front seal in the sealing position improves the sealing performance of the connector during operation, as mechanical disturbances like for instance vibrations can not effect the position of the front seal and can therefore not influence its sealing performance. The improved sealing performance makes the electrical connector suitable for usage in for instance automotive or aeronautical applications.

The indicator sleeve may be provided with at least one latching member to lock the indicator sleeve in the outer housing and in its final assembly position. An indicator sleeve that is locked in the outer housing in the final assembly state can not inadvertently be removed while retaining the front seal in the sealing position, ensuring that the front seal remains in its sealing position.

In another advantageous embodiment, the indicator sleeve may be provided with a further latching member next to the latching member mentioned above. The two latching members can be arranged one after the other in the contact direction and can engage consecutively with at least one counter latching member of the outer housing. During assemblage of the connector, first one latching member may mounted to the outer housing and may e.g. snap-fit with the at least one counter member. The further latching member may lock the indicator sleeve in the outer housing remote from its final assembly position. This ensures that the inner housing can be inserted into the outer housing until its final assembly position without being effected by the pre-assembled indicator sleeve. Furthermore, at least the indicator sleeve and the outer housing can form a first pre-assembly unit. The indicator sleeve can in a pre-assembled state being arranged remote from its final assembly position, still being affixed to the outer housing by the further latching member. In order to affix the indicator sleeve in the outer housing remote from its final assembly position, it can be locked to the outer housing via the further latching member.

When further inserting the indicator sleeve into the outer housing from the pre-assembled position and into its final assembly position, also the latching member may snap-fit with the at least one counter latching member or with another latching member. Hence, one snap-fit event may indicate that the indicator sleeve is inserted into the outer housing into the first pre-assembled state. Only if next to the first also a second snap-fit event occurs, the indicator sleeve has reached its final assembly position and a correct assemblage of the connector is indicated. In particular, it is indicated by the second snap-fit event that the inner housing is not only incompletely inserted into the outer housing but has reached its final assembly position in the outer housing.

In the incomplete assembly state, in which the inner housing is arranged at a distance from its final assembly position, the locking arrangement may at least section-wise be elastically deflected transverse to the contact direction and from an engagement position, in which the position of the inner housing is secured in the final assembly state, to a blocking position. In the blocking position, the locking arrangement may at least partially be arranged in the way of the indicator sleeve when it is inserted into the outer housing. The locking arrangement may be an integral part of the outer and/or the inner housing or may be a separate part that is locked or otherwise affixed to the outer and/or the inner housing in the final assembly state.

For instance, the locking arrangement may comprise a locking lever, whose free end may be elastically deflected in the incomplete assembly state. The free end may comprise a front or stop face pointing in the contact direction, with which the indicator sleeve may collide in the incomplete assembly state. Furthermore, the free end of the locking lever may comprise a securing protrusion, which may positively engage with a locking recess of the inner housing in the final assembly state. By the positive fit between the securing protrusion and the locking recess, the position of the inner housing is secured in its final assembly state and relative to the outer housing.

In the final assembly state, an engagement position of the locking arrangement may be secured by the indicator sleeve. Therefore, the indicator sleeve may overlap the locking arrangement transverse to the contact direction and block an elastic deflection of a section of the locking arrangement, e.g. of the free end of the locking lever.

If the electrical connector is to provide electro-magnetical shielding properties, it may have a shielding member that extends in the contact direction and between the inner and the outer housing in the final assembly state. At least the inner housing and the shielding member may be combined to form a second pre-assembly unit in a second pre-assembled state. Also, the second pre-assembly unit may be handled as a single piece. The shielding member may comprise elements for guiding it during the assemblage. Also the inner housing may have guiding means for the shielding member. For instance, the shielding member can be pushed or shifted over the inner housing in the contact direction, this movement being guided by the guiding means in cooperation with the guiding elements.

For instance, the shielding member may have at least one guiding bar extending in the contact direction, and the inner housing at least one guiding groove for the at least one guiding bar. The at least one guiding groove may extend in the contact direction and from a limit wall for the guiding bar towards an insertion end. Hence, the shielding member may be pushed onto the inner housing against the contact direction. In such an arrangement, the guiding groove may extend from the limit wall in the contact direction.

The guiding bar may be arranged on a free end of a guiding tongue of at least one of the shielding shells. The guiding tongue may be bent towards the opposite side plate and extend along the contact direction. The guiding tongue may be adapted to be at least section-wise received by the guiding groove when sliding the shielding shell along the contact direction and into its final assembly position. In the final assembly state, the guiding tongue may at least section-wise be received in the guiding groove and it may rest against the limit wall. Also, the opposite side plate may be formed with a guiding tongue, which can be bent towards the first side plate and that can be received by a guiding groove of the opposite side wall of the inner housing. The shielding member may comprise further guiding means, e.g. a guiding projection that may be embossed into the shielding member.

The second pre-assembly unit can in another advantageous embodiment be secured by the locking arrangement in a final assembly position in the final assembly state. Not only the inner housing but also the shielding member is thus secured in their final assembly position.

The shielding member may at least section-wise be arranged on lateral faces or side walls of the inner housing, the side walls extending parallel to the contact direction. For instance, the shielding member may comprise two shielding shells that can be placed upon opposite side walls of the inner housing transverse to the contact direction. The shielding shells may at least section-wise comprise a basically U-shaped cross-section with two side plates, which may extend at least over half of one side wall of the inner housing running parallel to the respective side wall or lateral face. Hence, all side walls of the inner housing can essentially be covered by the shielding member, which at least section-wise may have a hollow cylindrical shape.

Forming the shielding member as at least two shielding shells provides for an easy installation of the shielding member onto the inner housing. Each of the shielding shells may be moved towards the inner housing perpendicular to the contact direction from opposite sides. First, one shielding shell can be moved towards the inner housing until it is in contact with a lateral face of the inner housing. Then, it can be shifted along the contact direction until it is in contact with a stop face, e.g. the limit wall of the guiding groove or with another stop face. Afterwards, this procedure is repeated with the other shielding shell. The two shielding shell may be electrically interconnected at least by the crimp connection.

In order to achieve good shielding properties, it is desirable to prevent any gaps in the connection between a shielding of the cable and the shielding member. Therefore, the shielding member may at its end facing against the contact direction be featured with a neck section, which may be adapted to enclose the cable in the final assembly state. The crimp connection may be established by two crimping tubes that can be arranged in a concentric arrangement around the cable. A neck section of the shielding member, which may be adapted to the size of the cable, can be arranged between the two crimping tubes. By the crimp connection, the shielding member can be not only mechanically, but also electrically connected to the cable. For instance, a shielding foil of the cable can be in electrical contact with at least one of the two crimping tubes, such that the one crimping tube establishes an electrical connection between the shielding foil and the shielding member. In an advantageous embodiment, not only the neck section of the shielding member but also a part of the shielding foil can be arranged between the two crimping tubes, providing for a direct electrical connection between the foil and the shielding member.

As the shielding member may be e.g. by a latching tongue not only electrically but also mechanically connected to a shielding member of the counter connector, it may be favorable to arrange the limit wall at an end of the guiding groove, which points into the contact direction, resulting in a limit wall that faces against the contact direction. With such an arrangement, the shielding member can be slid over the inner housing in the contact direction until the guiding bar abuts on the limit wall. A further unintentional movement in the contact direction, e.g. by an un-mating procedure of the connector and the counter connector, is blocked by the limit wall.

The shielding member may have at least one locking member that is engaged with a locking structure of the inner housing in the pre-assembled state. In particular, the engagement between the locking member and the locking structure may prohibit that the shielding member slides off the inner housing at least against the contact direction while assembling the electrical connector.

The electrical connector may have a first contact position assurance member for securing the at least one contact assembly in its final assembly position. The first contact position assurance member may secure contact elements of the at least one contact assembly against unintentional movements in and/or against the contact direction.

Alternatively or additionally, the electrical connector may be provided with at least a second contact position assurance member for securing the inner housing in its final assembly position. The second contact position assurance member may be applied to the outer housing after the inner housing has reached its final assembly position. It may in particular prevent that the inner housing is moved relative to the outer housing and in the contact direction during an un-mating procedure of the contact and the counter contact.

It may be necessary to seal not only the connection between the connector and the counter connector but also the connection between the connector and the cable. Therefore, the electrical connector may comprise a cable seal which can enclose the cable in order prevent that humidity enters along an outer surface of the cable. In the final assembly state, the cable seal may be arranged in a rearward termination cap of the connector and may be in sealing contact with the inside of that rearward termination cap.

The invention will be described hereinafter and in an exemplary manner using advantageous embodiments and with reference to the drawings. The described configurations in which, however, the individual features as described above can be provided independently of one another or can be omitted are shown in the drawings.

Figure 1:
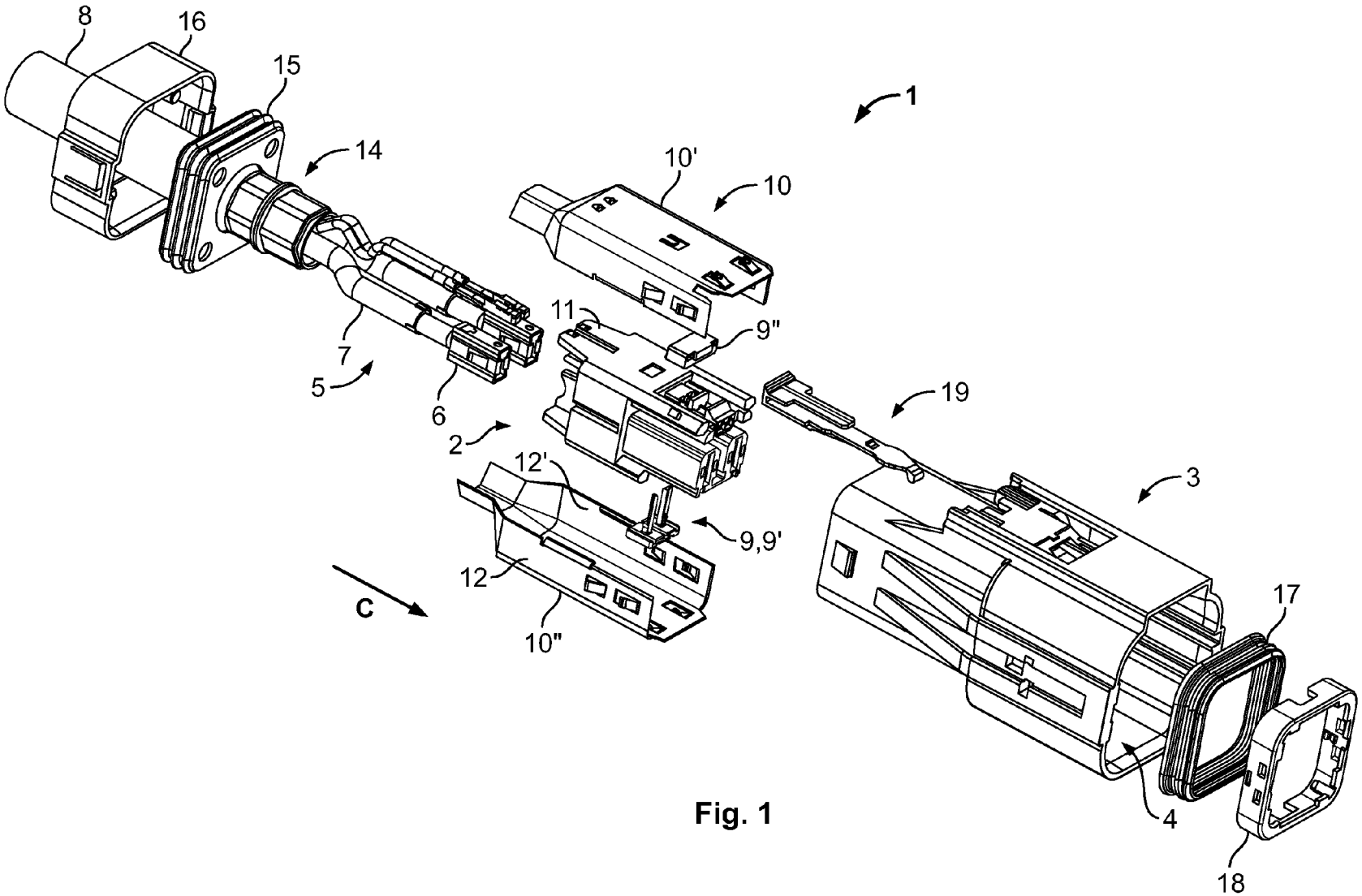
FIG. 1 is a schematic exploded view of an exemplary embodiment of the invention.

First, an electrical connector 1 according to the invention will be described with reference to FIG. 1, which shows an exploded view of an embodiment of the invention.

In some embodiments, the electrical connector 1 may comprise an inner housing 2 and an outer housing 3. The outer housing 3 may be adapted to receive at least the inner housing 2 in a contact direction C. In the contact direction C, the connector 1 can be connected with a counter connector. For instance, the outer housing 2 may basically comprise a hollow cylindrical shape. The outer housing 3 may form a duct or tunnel 4, which extends through the housing 3 in the contact direction C. Into the duct or tunnel 4, the inner housing 2 can be inserted in the contact direction C and into a final assembly position. Against the contact direction C the counter connector may at least section-wise be inserted into the duct 4.

The inner housing 2 may be adapted to receive at least one contact assembly 5. The contact assembly 5 may in some embodiments comprise at least one contact element 6, that can be affixed to the inner housing 2. For instance, the contact element 6 can be inserted into the inner housing 2 in the contact direction C and be locked to the inner housing 2. Furthermore, the contact element 6 can be conductively and mechanically connected to a wire 7 of a cable 8. If the cable 8 comprises more than one wire 7 or if more than one cable 8 shall be connected to the inner housing 2, the inner housing 2 can be adapted to receive more than one contact element 6. For instance, the contact assembly 5 may comprise four contact elements 6 and the inner housing 2 can be adapted to receive at least these four contact elements 6.

The connector 1 may in some embodiments be equipped with at least a first contact position assurance member 9, which can secure the relative position of at least one contact element 6 in the inner housing 2. The first contact position assurance member 9 may comprise at least one engagement protrusion 9', which may be engaged with the contact element 6 in a final assembly state of the connector 1, blocking movements of the contact element 6 at least against the contact direction C. The first contact position assurance member 9 may further comprise a fixation plate 9", which secures the engagement protrusion 9' from an unintentional removal from the inner housing 2.

In some embodiments, the electrical connector 1 may be a shielded electrical connector 1. For instance, the connector 1 may comprise a shielding member 10 that can at least section-wise be arranged on side walls 11 of the inner housing 2, the side walls 11 extending parallel to the contact direction C. For instance, the shielding member 10 may comprise two shielding shells 10', 10" that can be placed upon opposite side walls 11 of the inner housing 2 transverse to the contact direction C. The shielding shells 10', 10" may at least section-wise comprise a basically U-shaped cross section with two side plates 12, 12', which may each extend at least over half of one side wall 11 of the inner housing 2. Hence, all side walls 11 of the inner housing 2 can essentially be covered by the shielding member 10.

When assembling the connector 1, it may be advantageous, to first attach the contact element 6 or several contact elements 6 to leading ends of wires 7, to insert and secure the contact element 6 in the inner housing 2 and then to arrange the shielding member 10 on the outside of the inner housing 2. At least the inner housing 2 and the shielding member 10 can form a second pre-assembly unit, which can be handled as one piece.

If the cable 8 is of a shielded type, it may be favorable to electrically connect a shield of the cable 8 to the shielding member 10. In order to achieve good shielding properties, it is desirable to prevent any gaps in the connection between the shielding of the cable 8 and the shielding member 10. Therefore, the shielding member 10 may at its end facing against the contact direction C be featured with a neck section 13, which may be adapted to enclose the cable 8 in the final assembly state. The shielding member 10 may be affixed to the cable by a crimp connection 14 that can also provide for an electrical connection between the shield of the cable 8 and the shielding member 10.

In some environments, for instance in an automotive or an aeronautic environment, it may be necessary to seal the connector 1 against humidity. Therefore, the electrical connector 1 may in some embodiments comprise a cable seal 15, which can enclose the cable 8 in order to prevent that humidity enters along an outer surface of the cable 8. In the final assembly state, the cable seal 15, may be arranged in a rearward termination cap 16 and may be in sealing contact with the inside of the rearward termination cap 16.

Furthermore, it may be necessary to seal a connection between the connector 1 and the counter connector. Therefore, the connector 1 may comprise a front seal 17. The front seal 17 may have an essentially hollow cylindrical shape, such that it may encircle the duct 4. Transverse to the contact direction C, the front seal may be shaped complementary to the inner side of the outer housing 3. In FIG. 1, the front seal 17 basically has a rectangular cross-section.

When inserted into the outer housing 3 against the contact direction 4, the front seal 17 may be retained in a sealing position D in the outer housing by an indicator sleeve 18 at least in the final assembly state. The indicator sleeve 18 may be adapted to be at least section-wise inserted into the duct 4. At least the outer housing 3 and the indicator sleeve 18 may be combined to form a first pre-assembly unit, in which the indicator sleeve 18 may be mounted and e.g. locked in the outer housing remote from its final assembly position. Also the first pre-assembly unit can be handled as a single piece.

In the final assembly position of the inner housing 2 in the outer housing 3, the indicator sleeve 18 can be transferred from its pre-assembly position into its final assembly position. If, however, the inner housing 2 is arranged in the outer housing 3 at a distance from its final assembly position, a transfer of the indicator sleeve 18 into its final assembly position may be blocked.

In order to secure the inner housing 2 in its final assembly position, a locking arrangement may be provided. The locking arrangement may at least section-wise be elastically deflected when the inner housing 2 is arranged in the outer housing 2 remote from its final assembly position. Hence, at least a section of the locking arrangement may form a stop face, which blocks the transfer of the indicator sleeve 18 into its final assembly position.

In order to further secure an unintentional movement of the inner housing 2 relative to the outer housing 3 at least in the contact direction C, the connector 1 may be provided with a second contact position assurance member 19. The second contact position assurance member 19 may be affixed to the outer housing and may protrude into the duct 4 in the final assembly state.

Figure 2:
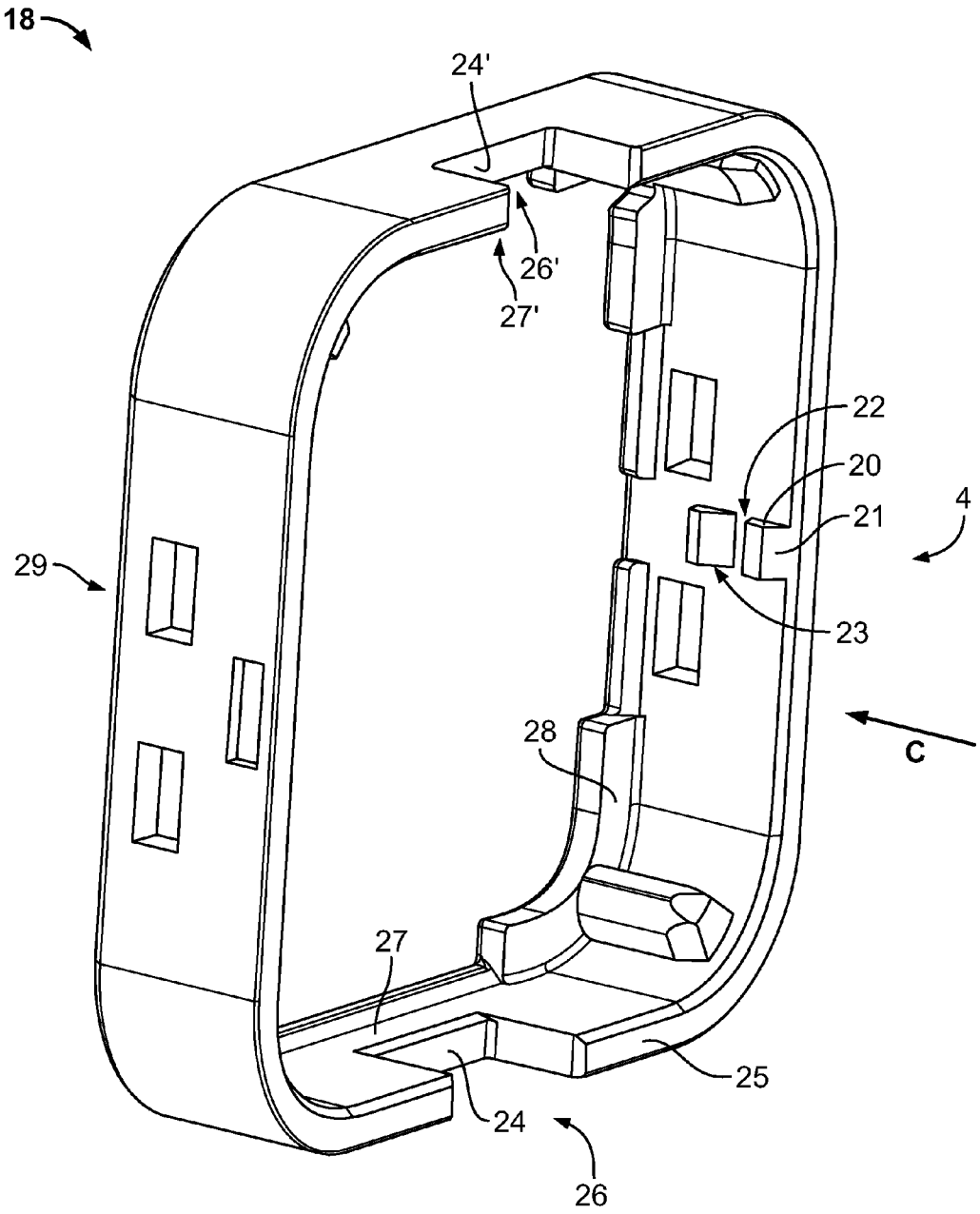
FIG. 2 is a schematic perspective view of an indicator sleeve.

FIG. 2 shows the indicator sleeve 18 in an enlarged perspective view.

The indicator sleeve 18 may basically comprise a hollow cylindrical shape and extend along the contact direction C. When mounted to the outer housing 3, duct 4 may extend through the indicator sleeve 18 along the contact direction C.

In some embodiments, at least one latching member 20 may be provided on the indicator sleeve 18. The latching member 20 may protrude from the indicator sleeve 18 perpendicular to the contact direction C in the final assembly state. For instance, the at least one latching member 20 may be shaped with a tapered surface 21, which may at least partly face against the contact direction C. Opposite of the tapered surface 21, the latching member 20 may be formed with a latching surface 22 that can extend perpendicular to the contact direction C.

In the contact direction C behind the latching member 20, the indicator sleeve 18 may comprise a further latching member 23, which may be of a shape comparable to the latching member 20. The further latching member 23 may be engaged with a counter latching member of the outer housing 3 in the final assembly state of the electrical connector 1. Latching member 20 may be engaged with a counter latching member of the outer housing at least in the first pre-assembled state.

Latching members 20, 23 may be provided on at least one or may be at least two inner side walls of the indicator sleeve 18. In particular, latching members 20, 23 can be arranged on opposite inner side walls of the indicator sleeve 18, whereas at least one latching member 20 and at least one further latching member 23 can be arranged on each of the opposite side walls.

In some embodiments, the first latching member 20 engages with the counter latching member of the outer housing 3 when assembling the electrical connector 1. Consecutively, the further latching member 23 may snap into engagement with the respective counter latching member of the outer housing 3. Thus, an operator assembling the electrical connector 1 may be able to distinguish the incomplete assembly state from the final assembly state by the amount of locking or snapping events when inserting the indicator sleeve 18 into the outer housing 3. Only one snapping or latching event indicates an incomplete assembly state, more than one and particularly two snapping or latching events indicate that the inner housing 2 is arranged in its final assembly position.

In some embodiments, the indicator sleeve 18 may be formed with a counter stop face 24, which faces against the contact direction C. The counter stop face 24 can interact with the stop face of the locking arrangement when the inner housing 2 is arranged at a distance from its finally assembly position.

When the counter stop face 24 abuts on the stop face of the locking arrangement, a further insertion of the indicator sleeve 18 into the outer housing 3 may be blocked. By blocking the movement, at least the further latching member 23 is prevented from engaging with the counter latching member of the outer housing 3.

The counter stop face 24 may be arranged behind a front face 25 of the indicator sleeve 18. For instance, the counter stop face 24 may be arranged in a recess 26, that is arranged in one of the side walls of the indicator sleeve 18 and that opens against the contact direction C. The indicator sleeve 18 may be shaped with a second counter stop face 24' that may be arranged on a ground of a further recess 26'. The recesses 26, 26' may be arranged in opposite side walls of the indicator sleeve 18.

Latching members 20 and further latching members 23 may be provided on different side walls than the recesses 26, 26'. The side walls, in which the recesses 26, 26' are arranged may run essentially perpendicular to the side walls on which the latching members 20 and the further latching members 23 may be provided.

Furthermore, the indicator sleeve 18 may be featured with a locking arrangement securing face 27, 27' behind each of the recesses 26, 26' in the contact direction C. In the final assembly state, at least one securing face 27, 27' may be arranged in front of a section of the locking arrangement, the section being elastically deflectable perpendicular to the contact direction C. The at least one securing face, 27, 27' may overlap the section of the locking arrangement transverse to the contact direction and lock a deflection of this section. Hence, the locking arrangement is prevented from an unintentional unlocking between the inner housing 2 and the outer housing 3.

In some embodiments, the indicator sleeve 18 may comprise at least one holding face 28 that may point against the contact direction C. The holding face 28 may be arranged behind the counter stop face 24 or even behind the securing face, 27, 27' essentially along a rear face 29 of the indicator sleeve 18. The holding face 28 may completely or at least partly extend around the duct 4. If more than one holding face 28 is provided, the holding faces 28 may be arranged symmetrically around the duct 4. At least the further latching member 23 can be arranged before the holding face in the contact direction C. The holding surface 28 arranged close to the rear face 29 of the indicator sleeve 18 may be formed in order to abut on the inner housing 2 in the final assembly state.

Figure 3:
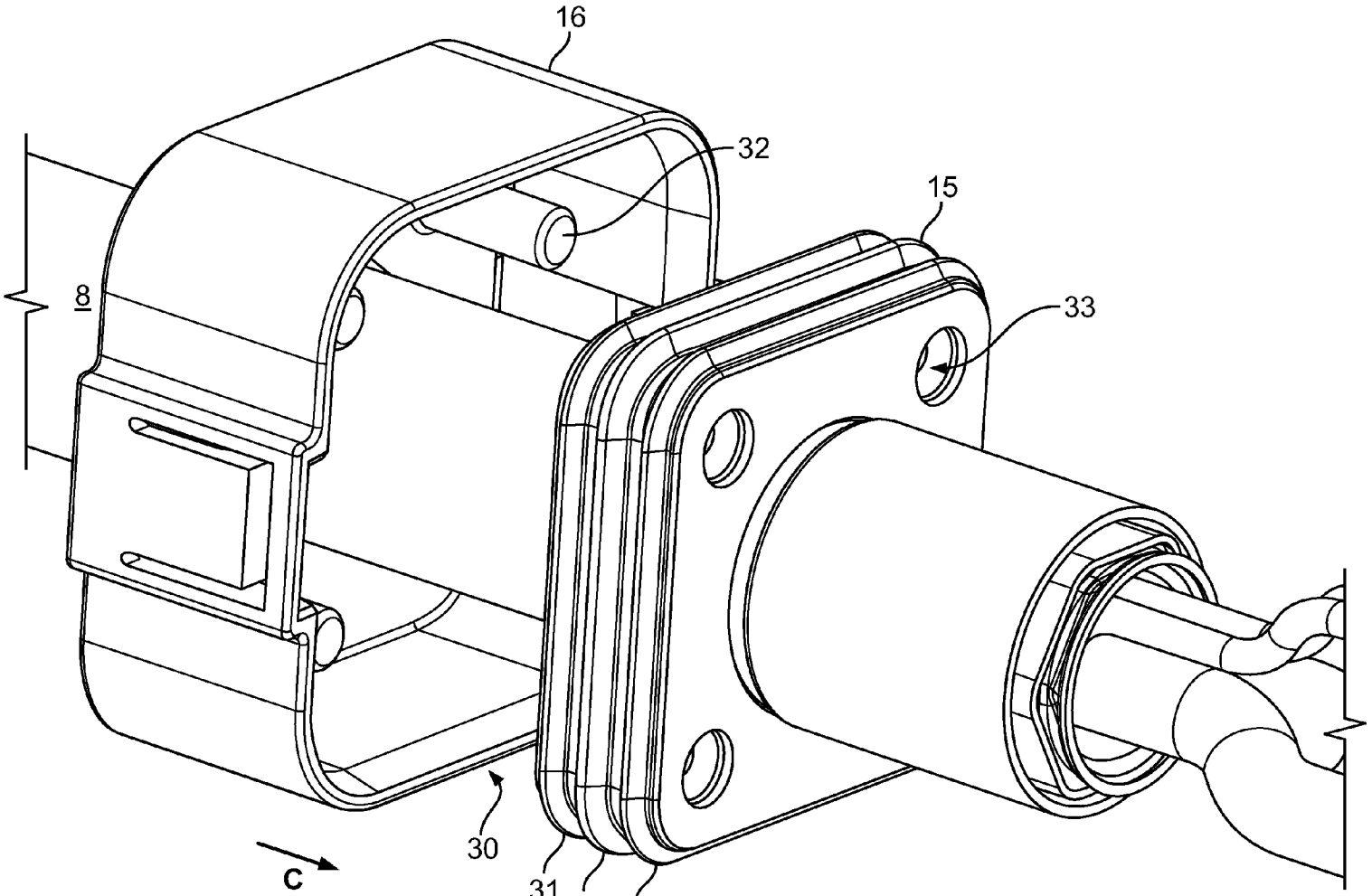
FIG. 3 shows an exemplary embodiment of a contact assembly.

FIG. 3 is an enlarged view of the contact assembly 5. The rearward termination cap 16 may open towards the contact direction C and the cable seal 15. The cable 8 can be led through the termination cap 16 and the front seal 17 along the contact direction C. In some embodiments, the termination cap 16 may have a receiving volume 30 that opens in the contact direction C for the cable seal 15. The receiving volume 30 may be shaped complementary to the cable seal 15, such that sealing ribs 31 sealingly abut against inner side walls of the termination cap 16. In order to secure the position of the cable seal 15 in the termination cap 15, at least sections of the cable seal 15 may positively engage with the termination cap 16. For instance, the termination cap 16 may be provided with at least one holding pin 32, which can be placed in a holding opening 33 of the cable seal 15 when the cable seal 15 is inserted into the receiving volume 30. One holding pin 32 may be arranged in each corner of the termination cap 16, which may have an essentially rectangular cross section perpendicular to the contact direction C. Respective holding openings 33 may be provided in the cable seal 15. Each holding opening 33 may sealingly enclose the holding pin 32 at least partially.

Figure 4:
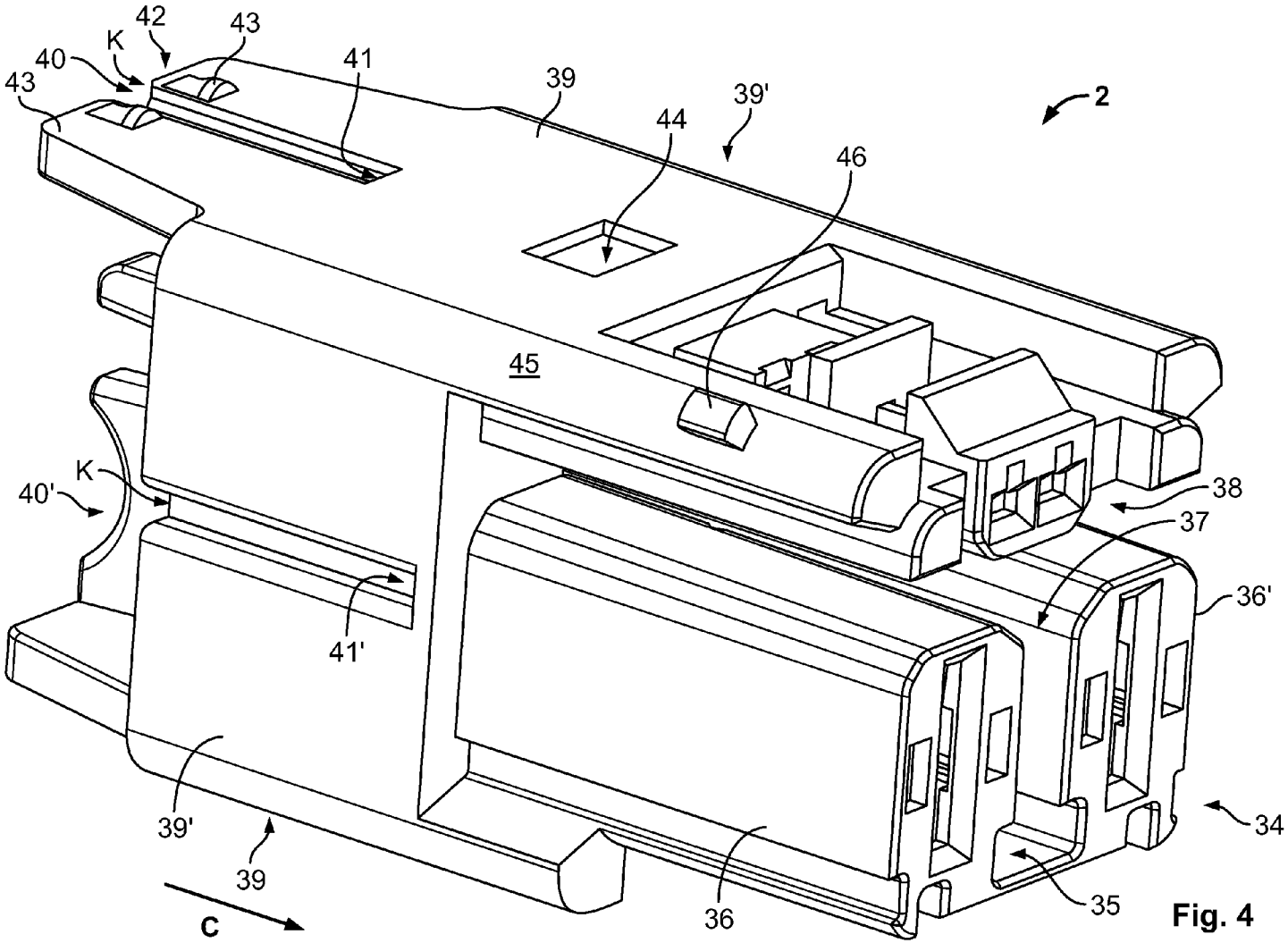
FIG. 4 is a schematic perspective view of an embodiment of an inner housing of the electrical connector.

FIG. 4 shows an enlarged view of the inner housing 2. A mating end 34 of the inner housing 2 faces in contact direction C and may, in the final assembly state of the electrical connector 1, form part of a contact face of the electrical connector 1. In some embodiments, the contact face may comprise a T-shaped guiding groove 35 that may extend in the contact direction C and that may be flanked by two contact cylinders 36, 36'. At an open end 37 of the guiding groove 35, the open end 37 pointing transverse to the contact direction C, a contact member 38 may be provided.

The contact member 38 may have locking means for affixing the electrical connector 1 to the counter connector. The mating end 34 may be integratable into a plug face of a male or a female electrical connector 1.

The inner housing 2 may be shaped with lateral faces or side walls 39, that extend along the contact direction C. In some embodiments, at least one of the lateral faces 39 may be formed with at least one guiding groove 40 extending in the contact direction 3 and ending in a limit wall 41. The limit wall 41 may essentially extend perpendicular to the contact direction C and may serve as a stop face for the shielding member 10. For instance, the limit wall 41 may face against the contact direction C, such that the guiding groove 40 opens against the contact direction C and ends in the contact direction C at the limit wall 41. The open end of the guiding groove 40 may be formed as an insertion end K for a section of the shielding member 10.

Guiding grooves 40 may be provided on opposite lateral faces 39. Alternatively or additionally, a guiding groove 40' may be provided on a lateral face or side wall 39' of the inner housing 2, the lateral faces or side walls 39, 39' extending under an angle and for instance perpendicular to each other. The guiding grooves 40, 40' may begin at a distance from each other in the contact direction C. For instance, guiding groove 40 may start before the guiding groove 40': Yet, the guiding grooves 40, 40' may have the same length in the contact direction C. Insertion ends K, K' of the guiding grooves 40, 40' may point into the same direction, e.g. against the contact direction C.

In some embodiments, the inner housing 2 may be formed with a locking structure 42 for the shielding member 10. By means of the locking structure 42, the shielding member 10 may be affixed along the contact direction C on the inner housing 2. For instance, the locking structure 42 may comprise at least one locking protrusion 43, which may project from one of the lateral faces 39. For instance, the locking protrusion 43 may be arranged next to one of the guiding grooves 40, 40' perpendicular to the contact direction C. If more than one locking protrusion 43 is provided, the locking protrusions 43 may flank the guiding groove 40, 40' transverse to the contact direction C.

In some embodiments, the inner housing 2 may comprise a part of the locking arrangement. For instance, it may be formed with a locking recess 44, that may be arranged on one of the lateral faces 39, 39' and in particular on the lateral face 39, on which also the locking structure 42 for the shielding member 10 can be provided. The locking recess 44 may open perpendicular to the contact direction C and may be arranged between one of the limit walls 41, 41' and the mating end 34.

The lateral faces 39, 39' may merge in a rounded shoulder 45 that extends parallel to the contact direction C. From the shoulder 45 a stop protrusion 36 for the shielding member 10 may project perpendicular from the shoulder 45 and to the contact direction C. A stop protrusion 46 for the shielding member 10 may project from one of the lateral faces 39, 39' or from the shoulder 45.

Figure 5:
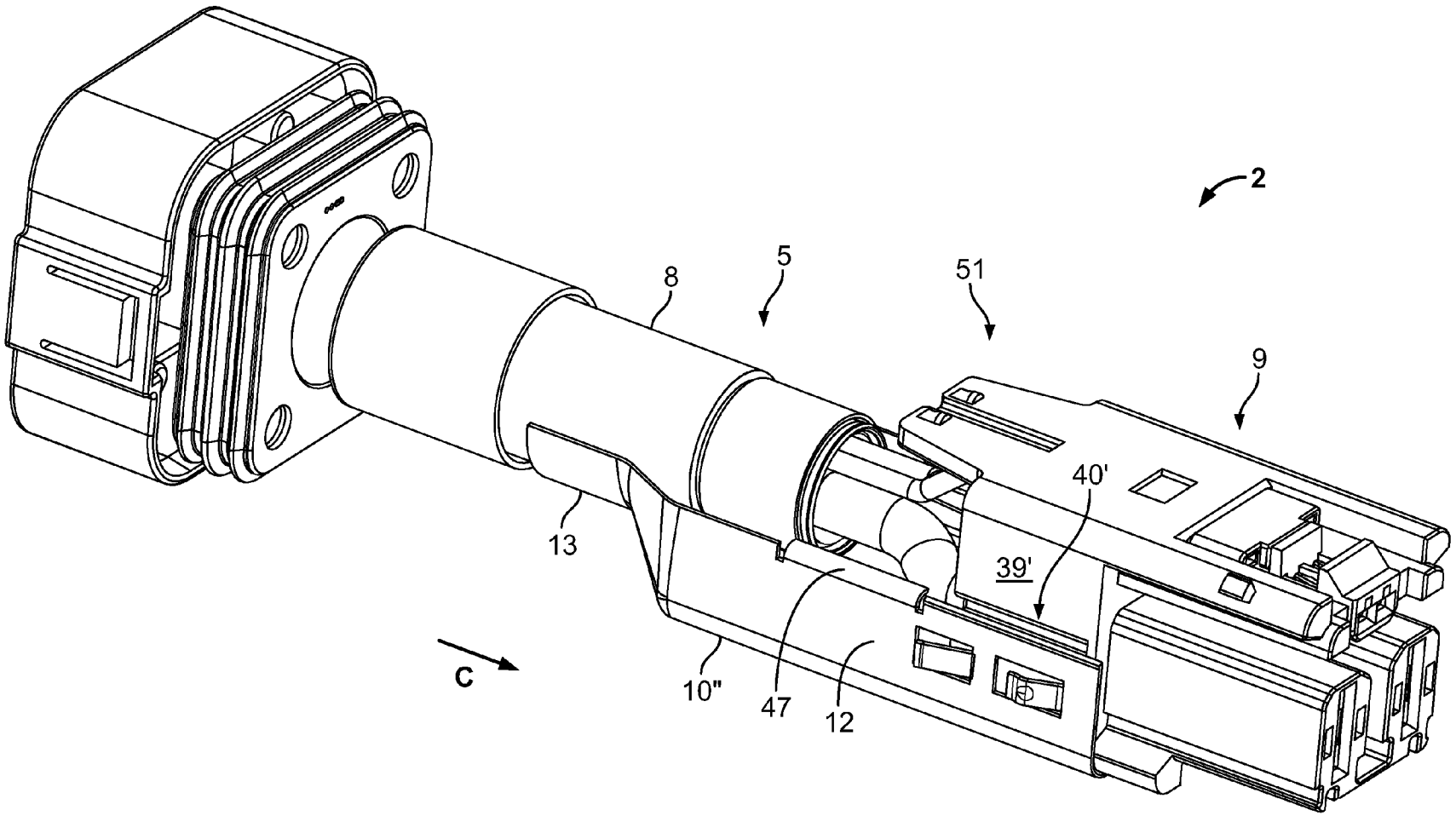
FIG. 5 is a schematic perspective view of a partly assembled second pre-assembly unit.

FIG. 5 shows the second pre-assembly unit 51 in a partly assembled state. Contact elements 6 of the contact assembly 5 may be connected to the inner housing 2 and secured in the inner housing 2 by the first contact position assurance member 9.

The neck section 13 of the shielding shell 10" lies against the cable 8, the side plate 12 of the shielding shell 10" at least partly overlapping the lateral face 39' of the inner housing 2.

For transferring the shielding shell 10" into its final assembly position, it may be slid in the contact direction C. A guiding tongue 47 of the shielding shell 10" may be bent towards the opposite side plate 12' and extend along the contact direction C. A free end of the guiding tongue 47 may be formed as a guiding bar 47', which points towards the inner housing 2 and extends parallel to the contact direction C. The guiding tongue 47 and at least its guiding bar 47' may be adapted to be received at least section-wise by the guiding groove 40' when sliding the shielding shell 10" along the contact direction C and into its final assembly position. In the final assembly state, the guiding tongue 47 may at least section-wise be received in the guiding groove 40' via its insertion end K'. Also the opposite side plate 12' may be formed with a guiding tongue 47, which can be bent towards the side plate 12 and that can be received by a guiding groove 40' of the opposite side wall 39'.

Figure 6:
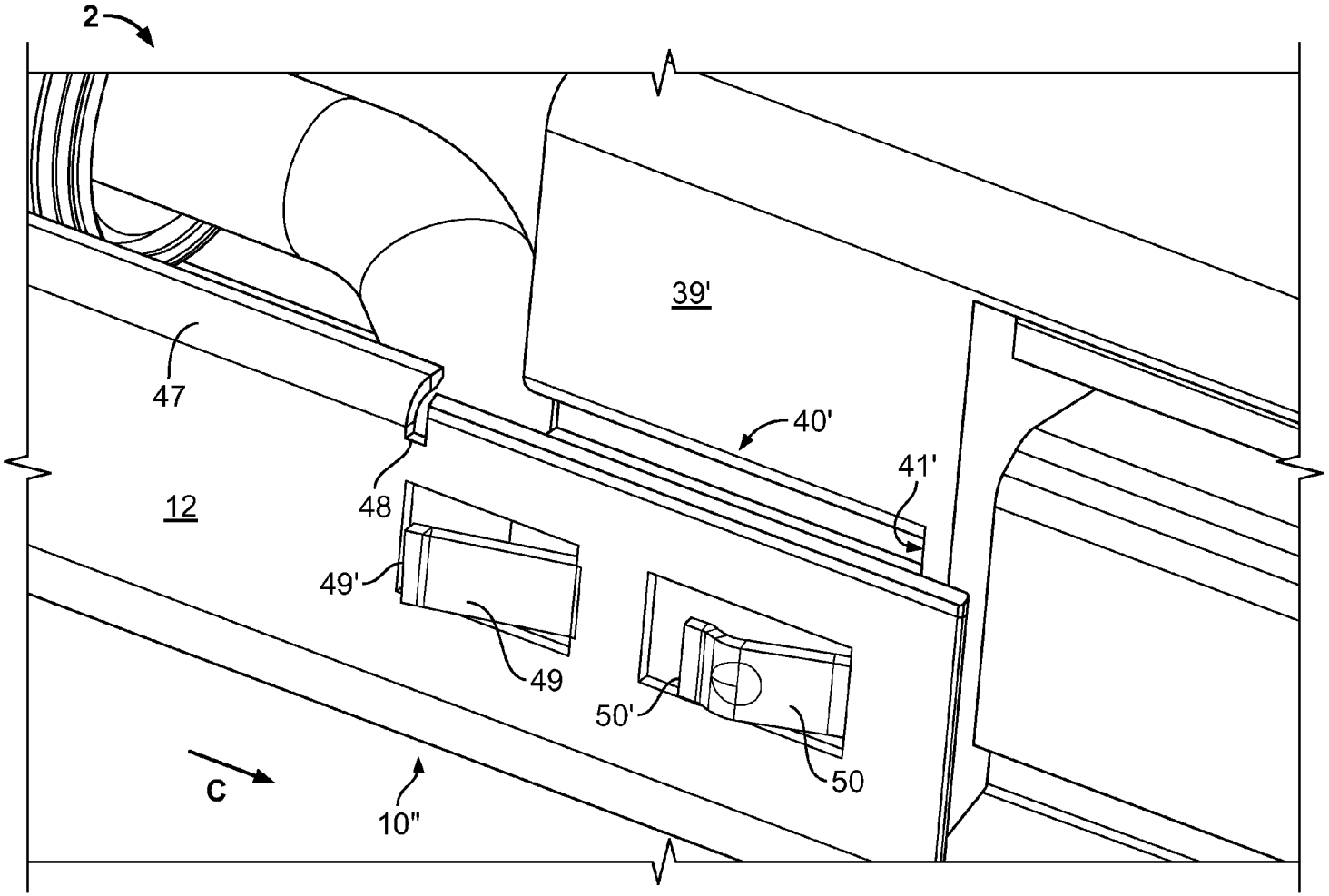
FIG. 6 shows an enlarged detail of FIG. 5.

FIG. 6 is an enlarged view of FIG. 5. Perpendicular to the contact direction C a pair of recesses may extend along the guiding tongue 47, of which only recess 48 is shown. The guiding tongue 47 may not project from the shielding shell 10" transverse to the contact direction C and parallel to the adjacent lateral face 39'. The guiding tongue 47 and the shielding shell 10" may end transverse to the contact direction C and parallel to the lateral face 39' of the inner housing 2 along a straight line.

Two latching tongues 49, 50 can protrude from the side plates 12, 12' of the shielding shells 10', 10" transverse to the contact direction C and away from the opposite side plates 12', 12. A latching tongue 49, 50 may be arranged before the guiding tong 12 in the contact direction C. Free ends of the latching tongues 49, 50 may point against the contact direction C and can be elastically deflectable towards the side plate 12.

Latching tongue 49 may be adapted to lock the shielding shells 10', 10" in the final assembly state of the electrical connector 1. The latching tongue 50, which may be arranged behind the latching tongue 49 in the contact direction C, may be adapted to latch with the counter connector. Furthermore, latching tongue 50 may also electrically be connected to a shielding member of the counter connector.

Figure 7:
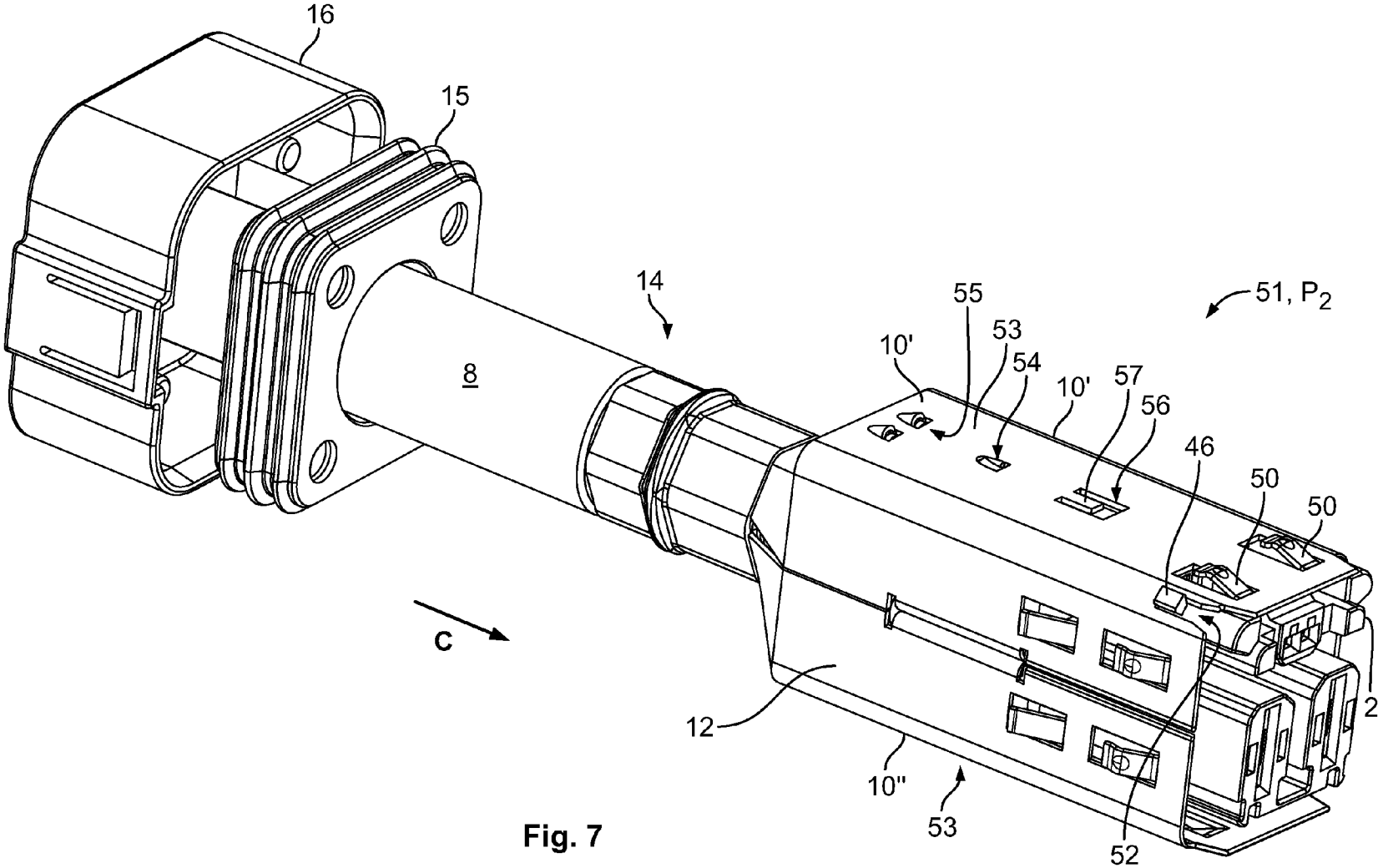
FIG. 7 shows the completely assembled second pre-assembly unit connected to a cable in a schematic perspective view.

FIG. 7 shows the second pre-assembly unit 51 in the second pre-assembled state P2. Both shielding shells 10', 10" are slid onto the inner housing 2. The shielding shells 10', 10" may be of a similar design and be arranged mirror-symmetric around the inner housing 2. At least shielding shell 10' may comprise a stop recess 52, which is put onto the stop protrusion 46. A center plate 53, which extends in the contact direction C and which interconnects the side plates 12, 12' is shown with two latching tongues 50 arranged next to each other in the contact direction C. Hence, the second pre-assembly unit 51 may comprise two latching tongues 50 on each side, the sides extending parallel to the contact direction C.

From the center plate 53 a guiding projection 54 may protrude towards the opposite shielding shell 10". The guiding projection 54 may engage with the guiding groove 40 of the inner housing 2 when sliding the shielding shell 10' onto the inner housing 2 in the contact direction C.

In some embodiments, at least one of the shielding shells 10',10" may comprise at least one locking member that is engaged with the locking structure 42 of the inner housing 2 in the pre-assembled state. For instance, the shielding shell 10' may comprise one locking member in the form of a locking opening 55 for each locking protrusion 43 of the inner housing 2.

The center plate 53 at least of the shielding shell 10' may be shaped with a through hole 56, which may be aligned with the locking recess 44 of the inner housing 2 in the pre-assembled state. The locking recess 44 can be reached via the through hole 56 from outside of the second pre-assembly unit. A latching tongue 57 may extend in the contact direction C towards its free end. The latching tongue 57 may engage with the locking arrangement of the electrical connector 1 or may be bent into the locking recess 44, further improving the mechanical connection between the shielding member 10 and the inner housing 2.

The second pre-assembly unit 51 may be connected to the cable 8. For instance, the shielding member 10 may be connected to the cable 8 by the crimping connection 14. The cable seal 15 and the rearward termination cap 16 may consecutively or together be pushed in the contact direction C towards the crimping connection 14 and overlap with the center plate 53 in the contact direction C.

Figure 8:
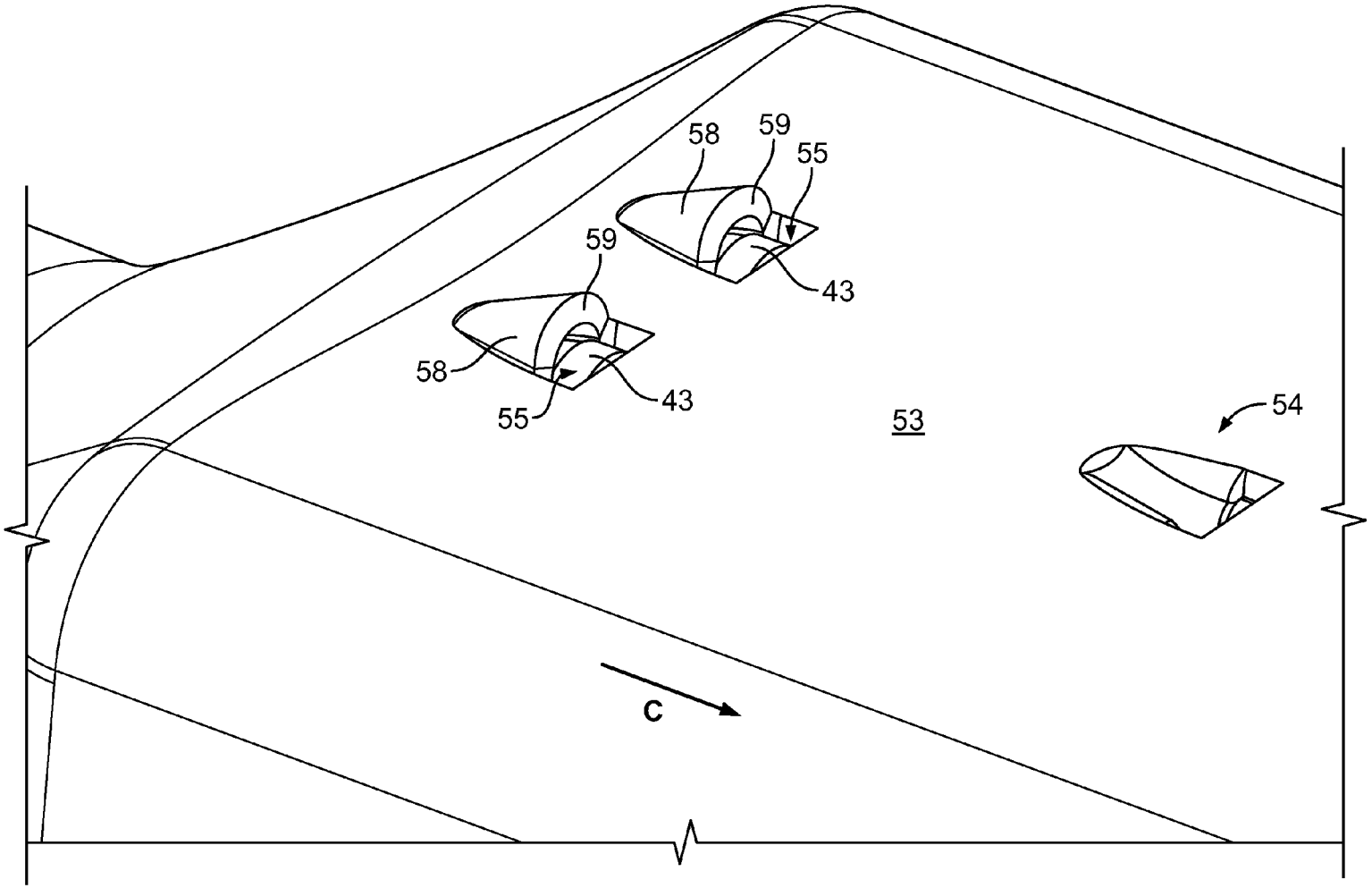
FIG. 8 shows an enlarged detail of FIG. 7.

FIG. 8 is an enlarged view of FIG. 7. Locking protrusions 43 project into the locking openings 55 transverse to the contact direction C and away from the inner housing 2. Before the locking openings 55 in the contact direction C stop cones 58 may be provided, of which only one half may protrude from the center plate 53 transverse to the contact direction C. Stop bases 59 of the stop cones 58 may face in the contact direction C and away from the inner housing 2. The stop bases 59 may block a further movement relative to the outer housing 3 in the contact direction C, when the second pre-assembly unit 51 has reached its final assembly position in the outer housing 3.

Figure 9:
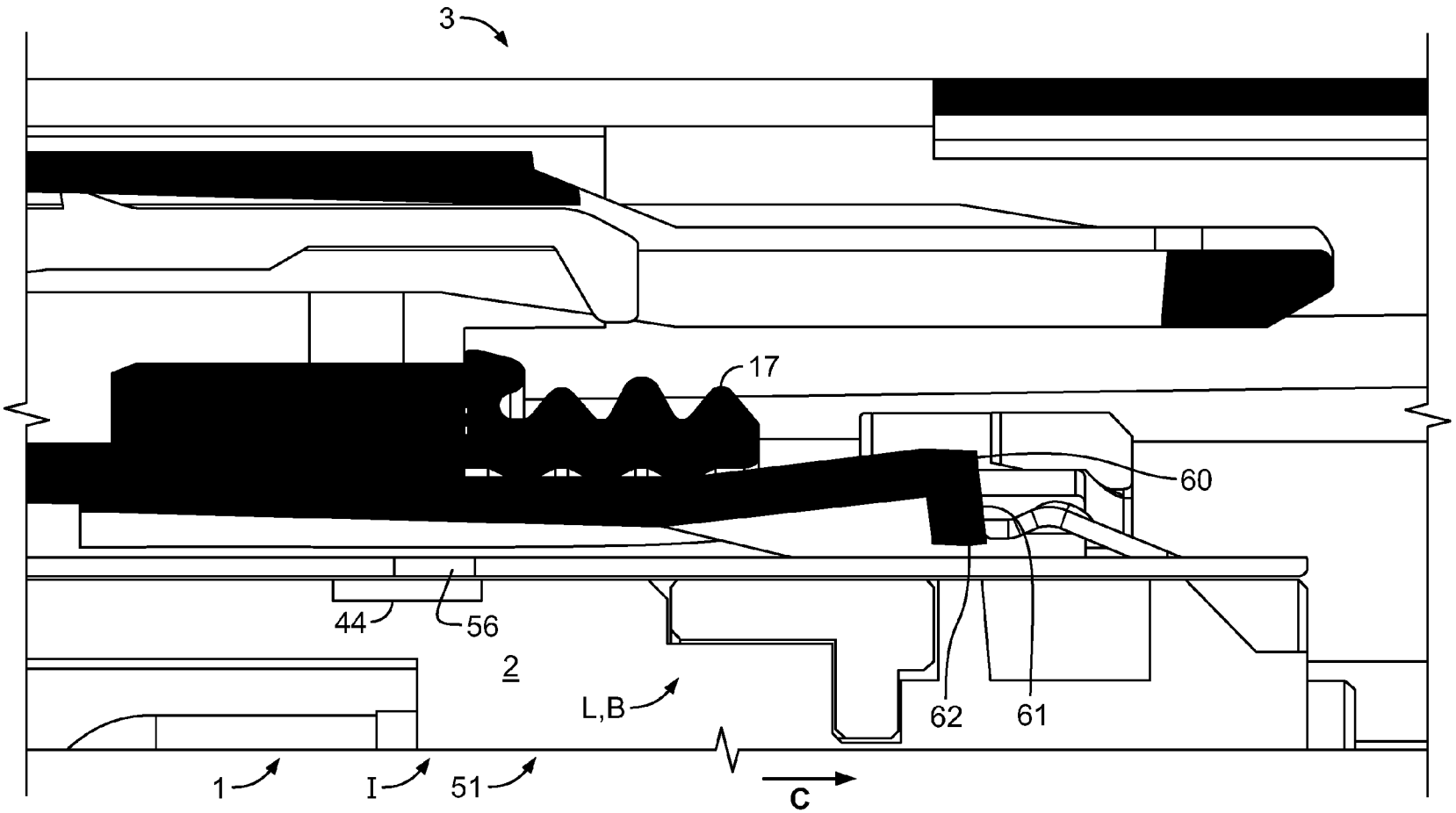
FIG. 9 shows a section of an exemplary embodiment of a locking arrangement according to the invention in a cross-sectional view.

FIG. 9 is a cross-sectional view of the electrical connector 1. The second pre-assembly unit 51 is arranged in the outer housing 3 in an incomplete assembly state I, in which the inner housing 2 is arranged before its final assembly position inside of the outer housing 3. A locking lever 60 of the locking arrangement L can be elastically deflected perpendicular to the contact direction C and away from the inner housing 2. It may slide on the inner housing 2 or on the shielding member 10 while inserting the inner housing 2 into the outer housing 3. Its front face 61 may act as a stop face 61 which may block the insertion of the indicator sleeve 18 into the outer housing 3 in the shown blocking position B.

When further inserting the inner housing 2 or the second pre-assembly unit 51 into the outer housing 3, locking recess 44 may fall in line with a securing protrusion 62 of the locking lever 60, which may then be pushed into the locking recess 44 by an elastic force caused by the locking lever 60. The securing protrusion 62 may project from the locking lever 60 perpendicular the contact direction C towards the inner housing 2. If the electrical connector 1 is of the shielded type, the securing protrusion 62 may extend through the through hole 56 into the locking recess 44. The front seal 17 is shown arranged in its sealing position D inside the outer housing 3.

Figure 10:
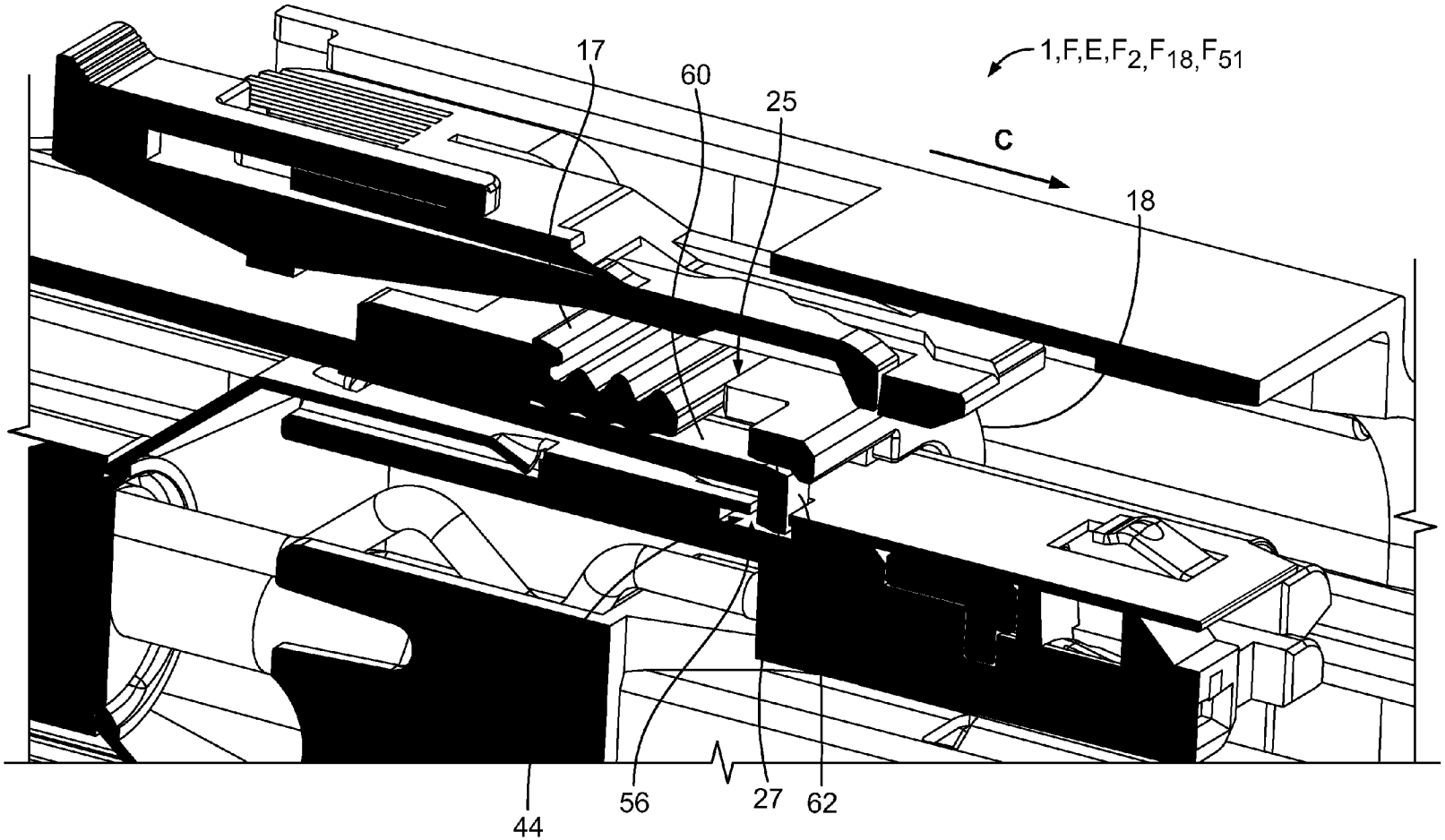
FIG. 10 is a further cross-sectional view of the connector in a final assembly state.

FIG. 10 is a perspective cross-sectional view of the electrical connector 1 in the final assembly state F. The inner housing 2 has reached its final assembly position F2 in the outer housing 3. If the connector 1 is of a shielded type, the second pre-assembly unit 51 is shown arranged in its final assembly position F51. Also, the indicator sleeve 18 is positioned in its final assembly position F18.

The securing protrusion 62 may in the shown final assembly state F be arranged in its engagement position E, in which it is at least section-wise arranged in the locking recess 44 and/or through the through hole 56. The locking lever 60 may be un-bent or only slightly elastically bent perpendicular to the contact direction C away from the inner housing 2. By the positive fit between the securing protrusion 62 and the locking recess 44 the position of the inner housing 2 inside of the inner housing 3 is secured. The locking lever 60 may be an integral part of the outer housing 3 or may be a separate part, which can be locking or affixed to the outer housing 3. The locking arrangement L may at least comprise the locking lever 16 and at least one counter locking element, for instance, the locking recess 44 and/or the through hole 56.

In the final assembly state F, the indicator sleeve 18 has reached its final assembly position F18. The front face 25 of the indicator sleeve 18 may abut against the front seal 17 and secure the front seal 17 against movements out of its final assembly or sealing position D in the contact direction C.

The securing face 27 can overlap the locking lever 60 at its securing protrusion 62, blocking movements of the securing protrusion 62 out of its engagement position E and the positive engagement with the locking recess 44.

Figure 11:
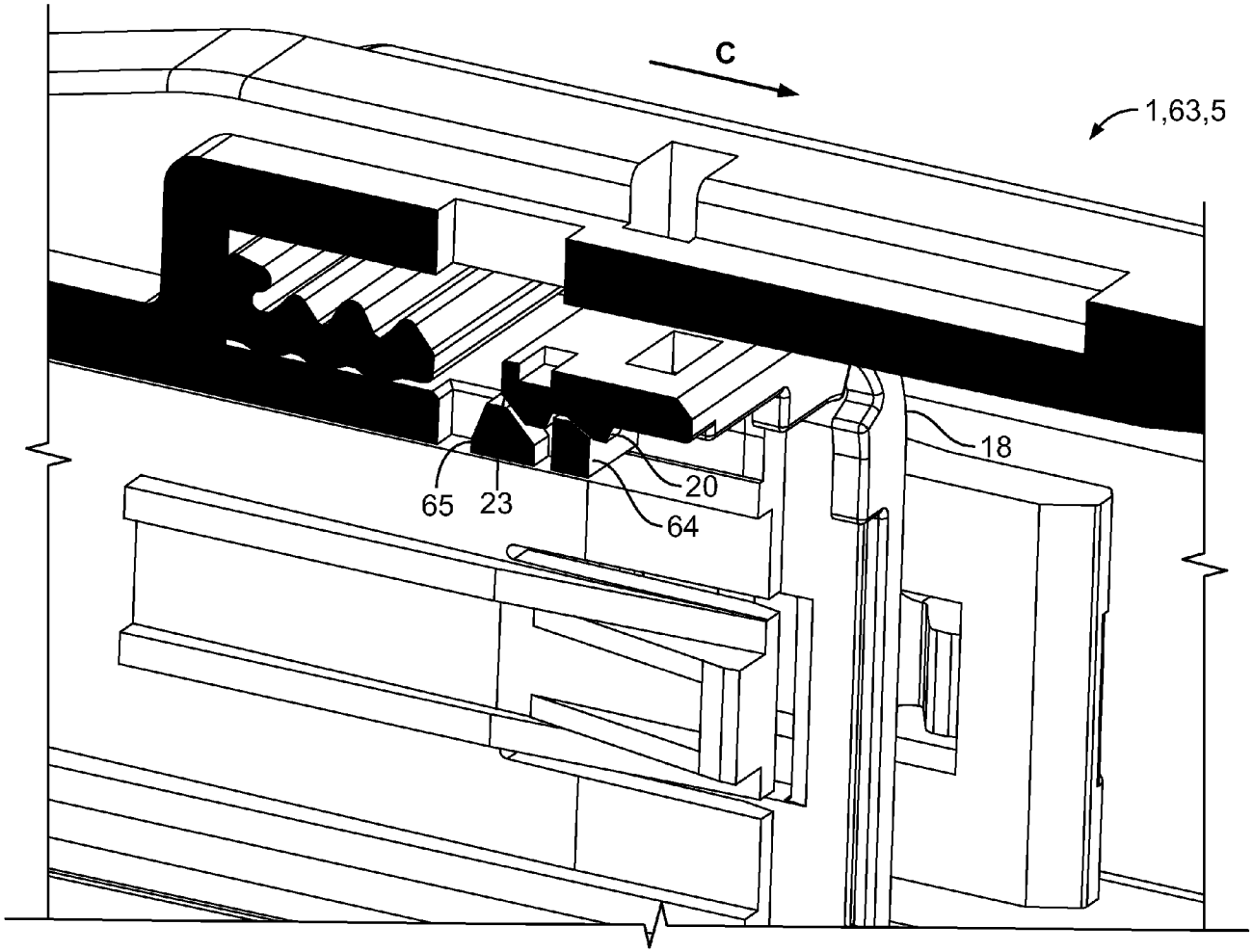
FIG. 11 shows another cross-sectional view of a first pre-assembly unit of the connector.

FIG. 11 shows a first pre-assembly unit 63 in a first pre-assembled state P1. The indicator sleeve 18 is latched to the outer housing 3 by its further latching member 23, that is engaged with a first counter latching member 64. The further latching member 23 engages behind the first counter latching member 64, such that an unintentional movement of the indicator sleeve 18 in the contact direction C is being avoided. When inserting the indicator sleeve 18 further into the outer housing 3 against the contact direction C, the latching member 20 can be pushed over the first counter latching member 64. Furthermore, the further latching member 23 can be pushed over a second counter latching member 65 when transferring the indicator sleeve 18 from the shown pre-assembly position S into the final assembly state F.

The invention claimed is:

1. An electrical connector with an inner housing that is adapted to receive at least one contact assembly, an outer housing and a locking arrangement, wherein the inner housing is adapted to be inserted into the outer housing in a contact direction during an assemblage of the connector and wherein the relative position of the inner to the outer housing is secured by the locking arrangement in a final assembly state of the connector, wherein the connector has an indicator sleeve that is adapted to be inserted into the outer housing against the contact direction during the assemblage of the connector and wherein, in an incomplete assembly state, in which the inner housing is arranged at a distance from its final assembly position in the outer housing, the locking arrangement forms a stop face for the indicator sleeve, blocking a transfer of the indicator sleeve into its final assembly position.

2. The electrical connector according to claim 1, wherein the connector has a front seal that is adapted to seal the outer housing and a housing of a mated counter connector, the front seal being retained in a sealing position in the outer housing by the indicator sleeve at least in the final assembly state.

3. The electrical connector according to claim 1, wherein a first pre-assembled state, at least the indicator sleeve and the outer housing form a first pre-assembly unit, the indicator sleeve in the first pre-assembled state being mounted remote from its final assembly position.

4. The electrical connector according to claim 1, wherein the indicator sleeve is provided with at least one latching member to lock the indicator sleeve in the outer housing remote from its final assembly position.

5. The electrical connector according to claim 1, wherein the incomplete assembly state, the locking arrangement is at least section-wise elastically deflected transverse to the contact direction and from an engagement position, in which the position of the inner housing is secured in the final assembly state, to a blocking position.

6. The electrical connector according to claim 1, wherein the indicator sleeve secures an engagement position of the locking arrangement in the final assembly state.

7. The electrical connector according to claim 1, wherein the connector has at least a first contact position assurance member for securing the at least one contact assembly in its final assembly position.

8. The electrical connector claim 1, wherein the connector has at least a second contact position assurance member for securing the inner housing in its final assembly position.

9. The electrical connector according to 1, wherein the connector has a shielding member that extends in the contact direction and between the inner and the outer housing at least in the final assembly state, wherein at least the inner housing and the shielding member are combined to form a second pre-assembly unit in a second pre-assembled state.

10. The electrical connector according to claim 9, wherein a final assembly position of the second pre-assembly unit is secured by the locking arrangement in the final assembly state.

11. The electrical connector according to claim 9, wherein the shielding member has at least one guiding bar and the inner housing has at least one guiding groove for the at least one guiding bar, the at least one guiding groove extending in the contact direction and from a limit wall for the guiding bar towards an insertion end.

12. The electrical connector according claim 9, wherein the shielding member has at least one locking member that is engaged with a locking structure of the inner housing in the second pre-assembled state.

13. The electrical connector according to claim 9, wherein a crimp connection between the cable and the shielding member is established by two crimping tubes that can be arranged in a concentric arrangement around the cable, wherein a neck section of the shielding member is arranged between the two crimping tubes.

* * * * *